US005518147A

United States Patent [19]

Peterson et al.

[11] Patent Number: 5,518,147

[45] Date of Patent: May 21, 1996

[54] COLLAPSIBLE PUMP CHAMBER HAVING PREDETERMINED COLLAPSING PATTERN

[75] Inventors: Robert J. Peterson, Loveland; Robert E. Stahley, Middletown, both of Ohio

[73] Assignee: The Procter & Gamble Company, Cincinnati, Ohio

[21] Appl. No.: 204,122

[22] Filed: Mar. 1, 1994

[51] Int. Cl.[6] ..... B67D 5/33

[52] U.S. Cl. ..... 222/153.07; 222/153.13; 222/207; 222/212; 222/321.7

[58] Field of Search ..... 222/153, 207, 222/212, 213, 384, 321, 562, 211, 321.7, 153.07, 153.13, 383.1; 239/333

[56] References Cited

U.S. PATENT DOCUMENTS

| | | | |
|---|---|---|---|
| 2,774,518 | 12/1956 | Greene | 222/209 |
| 2,824,672 | 2/1958 | Wersching | 222/207 |
| 3,124,275 | 3/1964 | Lake | 222/182 |
| 3,193,154 | 7/1965 | Bross | 222/207 |
| 3,471,092 | 10/1969 | Hickey | 239/579 |
| 3,752,366 | 8/1973 | Lawrence, Jr. | 222/207 |
| 3,910,444 | 10/1975 | Foster | 215/295 |
| 3,973,700 | 8/1976 | Schmidt et al. | 222/153 |
| 4,082,223 | 4/1978 | Nozawa | 239/333 |
| 4,101,057 | 7/1978 | LoMaglio | 222/207 |
| 4,120,429 | 10/1978 | Vignot | 222/207 |
| 4,147,282 | 4/1979 | Levy | 222/387 |
| 4,220,264 | 9/1980 | Gamadia | 222/207 |
| 4,232,828 | 11/1980 | Shelly, Jr. | 239/329 |
| 4,260,079 | 4/1981 | Cary et al. | 222/209 |
| 4,273,290 | 6/1981 | Quinn | 239/493 |
| 4,310,104 | 1/1982 | Takatsuki | 222/131 |
| 4,313,568 | 2/1982 | Shay | 239/333 |
| 4,318,498 | 3/1982 | Magers et al. | 222/153 |
| 4,336,895 | 6/1982 | Aleff | 222/207 |
| 4,358,057 | 11/1982 | Burke | 239/333 |
| 4,589,574 | 5/1986 | Foster | 222/153 |
| 4,624,413 | 11/1986 | Corsette | 239/333 |
| 4,640,444 | 2/1987 | Bundschuh | 222/321 |
| 4,651,904 | 3/1987 | Schuckmann | 222/383 |
| 4,655,690 | 4/1987 | Boedecker et al. | 417/53 |
| 4,732,549 | 3/1988 | von Schuckmann | 417/472 |
| 4,781,311 | 11/1988 | Dunning et al. | 222/153 |
| 4,846,372 | 7/1989 | von Schukmann | 222/136 |
| 4,858,478 | 8/1989 | Kush et al. | 73/864.35 |
| 4,858,788 | 8/1989 | Meckenstock | 222/207 |
| 4,863,070 | 9/1989 | Andris | 222/207 |
| 4,898,307 | 2/1990 | Tiramani | 222/207 |
| 4,915,601 | 4/1990 | von Schuckmann | 417/472 |
| 4,979,646 | 12/1990 | Andris | 222/136 |
| 5,014,881 | 5/1991 | Andris | 222/207 |
| 5,018,894 | 5/1991 | Goncalves | 401/202 |
| 5,031,802 | 7/1991 | Joulia | 222/205 |
| 5,042,694 | 8/1991 | Birmelin | 222/145 |
| 5,096,094 | 3/1992 | Guilbert | 222/153 |
| 5,114,052 | 5/1992 | Tiramani et al. | 222/207 |
| 5,158,211 | 10/1992 | Meshberg | 222/153 |
| 5,190,190 | 3/1993 | Fudalla | 222/105 |
| 5,195,878 | 3/1993 | Sahiavo et al. | 417/393 |
| 5,197,866 | 3/1993 | Kim | 417/472 |
| 5,205,441 | 4/1993 | Andris | 222/207 |
| 5,234,166 | 8/1993 | Foster et al. | 239/333 |
| 5,303,850 | 4/1994 | Connan | 222/153 |
| 5,303,867 | 4/1994 | Peterson | 222/207 |
| 5,333,761 | 8/1994 | Davis et al. | 222/212 |
| 5,439,178 | 8/1995 | Peterson | 239/333 |

FOREIGN PATENT DOCUMENTS

| | | |
|---|---|---|
| 1442883 | 5/1966 | France . |
| 2524348 | 10/1983 | France . |
| 3909633 | 10/1990 | Germany . |

*Primary Examiner*—Andres Kashnikow
*Assistant Examiner*—Philippe Derakshani
*Attorney, Agent, or Firm*—Michael E. Hilton

[57] ABSTRACT

A collapsible pump chamber, e.g., a bellows, for use with a liquid dispensing pump device is provided. The collapsible pump chamber includes a collapsing side wall which defines an internal volumetric portion of the pump chamber. The collapsing side wall has a structure which collapses in a predetermined pattern as the pump device is actuated. For example, the predetermined pattern of collapse could result in an initially relatively small volumetric change in internal volume per given stroke length followed by an increased volumetric change in internal volume per given stroke length. Thus, the pump device would initially provide very good control over the amount of product is dispensed; giving precise control during a partial actuation. However, the same pump device would also be capable of delivering a large volume of product during a complete actuation.

20 Claims, 8 Drawing Sheets

COLLAPSIBLE PUMP CHAMBER HAVING PREDETERMINED COLLAPSING PATTERN

BACKGROUND OF THE INVENTION

1. Field of the Invention

The present invention relates to manually compressible pump chambers for use with consumer product liquid dispensing pump devices.

2. Description of the Prior Art

Known liquid dispensing pump devices for use with consumer product containers are many and varied. Such dispensing pumps may be utilized to deliver liquids as a foam, a spray, or a liquid stream (e.g., as with moisturizing lotions), for example. Most commonly, such liquid dispensing pump devices utilize a piston and cylinder pump chamber. Such pump chambers require that a liquid tight moving seal be maintained between the piston and the cylinder. Disadvantages are commonly associated with this liquid tight seal requirement. For example, a relatively large amount of friction is generated as the piston moves against the cylinder, since these parts must fit tightly to form the seal. Additionally or alternatively, the parts themselves must be manufactured within tight tolerances such that the parts fit correctly to form the seal. Moreover, the wear caused by the friction can deteriorate this seal over time, reducing the efficiency of the pump. Furthermore, these piston and cylinder dispensing devices have generally been designed without significant effort to reduce the number of parts and overall cost.

Partially in response to some of the disadvantages of piston and cylinder-type pumps, several liquid dispensing pump devices have been developed which utilize pump chambers with collapsible walls. For example, balloon type pump chambers have been utilized. More commonly, flexible, resilient bellows have been utilized as collapsible pump chambers in liquid dispensing pump devices. Such bellows-type pumps permit the pump chamber to expand and contract in volume without the disadvantages associated with the moving seal required in piston and cylinder pumps. Furthermore, the bellows can replace the piston, the cylinder and the spring; thereby reducing molding and assembly costs. These prior liquid dispensing pump devices, however, do not offer all of the advantages of the invention described herein.

SUMMARY OF THE INVENTION

In accordance with one aspect of the present invention a collapsible pump chamber for use in a manually actuated liquid dispensing pump device is provided. The collapsible pump chamber includes a pleated annular side wall defining an internal volumetric portion of the pump chamber. Moreover, the pleated annular side wall has a structure adapted to collapse in a predetermined pattern as the pump device is actuated. Preferably, the predetermined pattern of collapse results in an initially relatively small volumetric change in the internal volumetric portion per given stroke length followed by an increased volumetric change in the internal volumetric portion per given stroke length.

In accordance with another aspect of the present invention a manually operated liquid dispensing device is provided. The dispensing device includes a housing for sealingly mounting the dispensing device to a supply container. The housing includes a portion of a liquid passage providing fluid communication from the supply container downstream to the discharge orifice. An inlet valve is located within the liquid passage. The inlet valve is closed to prevent liquid flow therethrough during periods of positive downstream pressure and is open during periods of negative downstream pressure. An outlet valve is located within the liquid passage, the outlet valve is open to permit liquid flow therethrough during periods of positive upstream pressure and is closed during periods of negative upstream pressure. A collapsible pump chamber defines a portion of the liquid passage downstream of the inlet valve and upstream of the outlet valve. The collapsible pump chamber has a collapsing side wall defining a portion of the pump chamber. The collapsing side wall has a structure adapted to collapse in a predetermined pattern as the pump device is actuated.

BRIEF DESCRIPTION OF THE DRAWINGS

While the specification concludes with claims particularly pointing out and distinctively claiming the present invention, it is believed the present invention will be better understood from the following description in conjunction with the accompanying drawings in which:

DETAILED DESCRIPTION OF THE INVENTION

Figure 1:
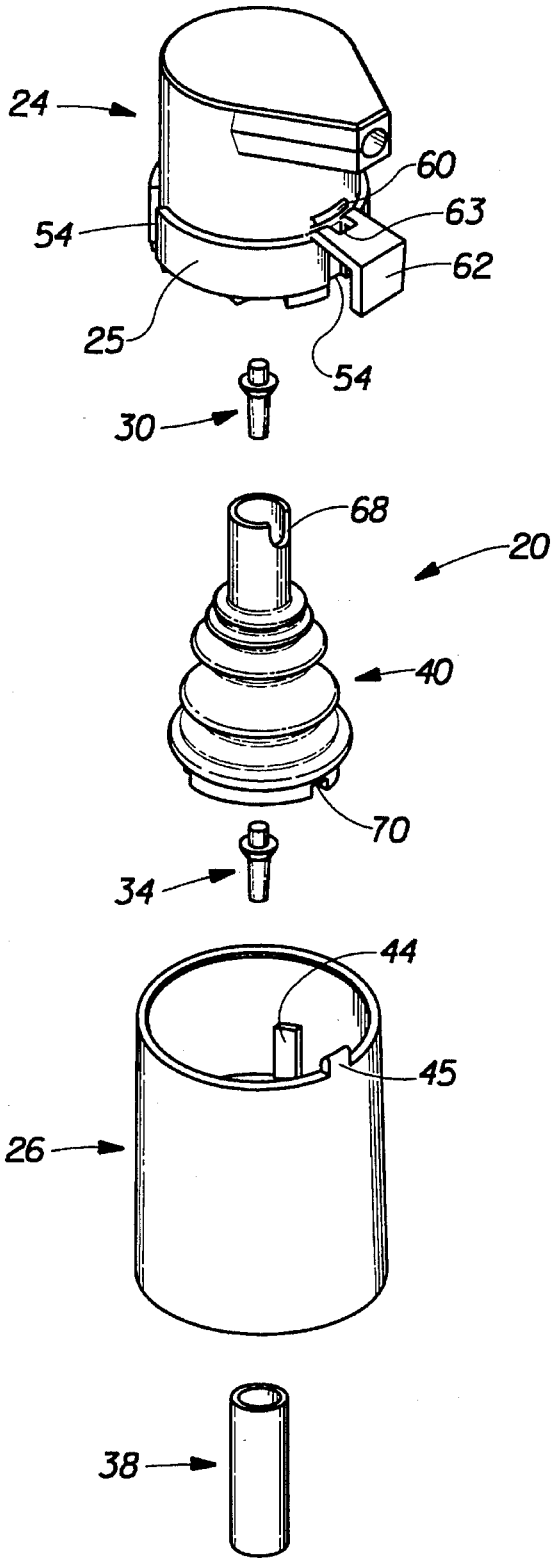
FIG. 1 is an expanded perspective view from above of a particularly preferred embodiment of a manually collapsible pump chamber for use in a liquid dispensing pump of the present invention.

In a particularly preferred embodiment shown in FIG. 1, the present invention provides a manually compressible pump chamber 40 for use in a liquid dispensing pump device, indicated generally as 20. This dispensing pump device 20 is particularly useful in conjunction with a liquid product supply container 22 (seen partially in FIG. 3). The illustrated liquid dispensing pump 20 basically includes an upper housing 24, a lower housing 26, an outlet valve member 30, and inlet vent member 34, a diptube 38, and a collapsible pump chamber 40.

As used herein, the phrase "collapsible pump chamber" is defined as a pump chamber delineated—at least partially—by a flexible wall which moves in response to a manual compressive force in such a way that the volume within the pump chamber is reduced without sliding friction between any components delineating the pump chamber. Such collapsible pump chambers may include balloon-like diaphragms and bladders made from elastomeric materials such as thermoplastic elastomers, elastomeric thermosets (including rubber), or the like. For example (not seen), the collapsible pump chamber may include a helical metal or plastic spring surrounding (or covered by) an elastic material; creating an enclosed pump chamber. However, the illustrated and preferred collapsible pump chamber is a bellows 40; i.e., a generally cylindrical, hollow structure with accordion-type walls. Bellows are preferred, for example, because they can be made resilient to act like a spring; eliminating the need for a spring. Furthermore, the collapsible pump chamber is designed in such a manner that it collapses according to a predetermined pattern. Also the manually collapsible pump chamber preferably includes additional integral components. As used herein, the term "integral" is defined as molded, or otherwise formed, as a single unitary part.

Figure 3:
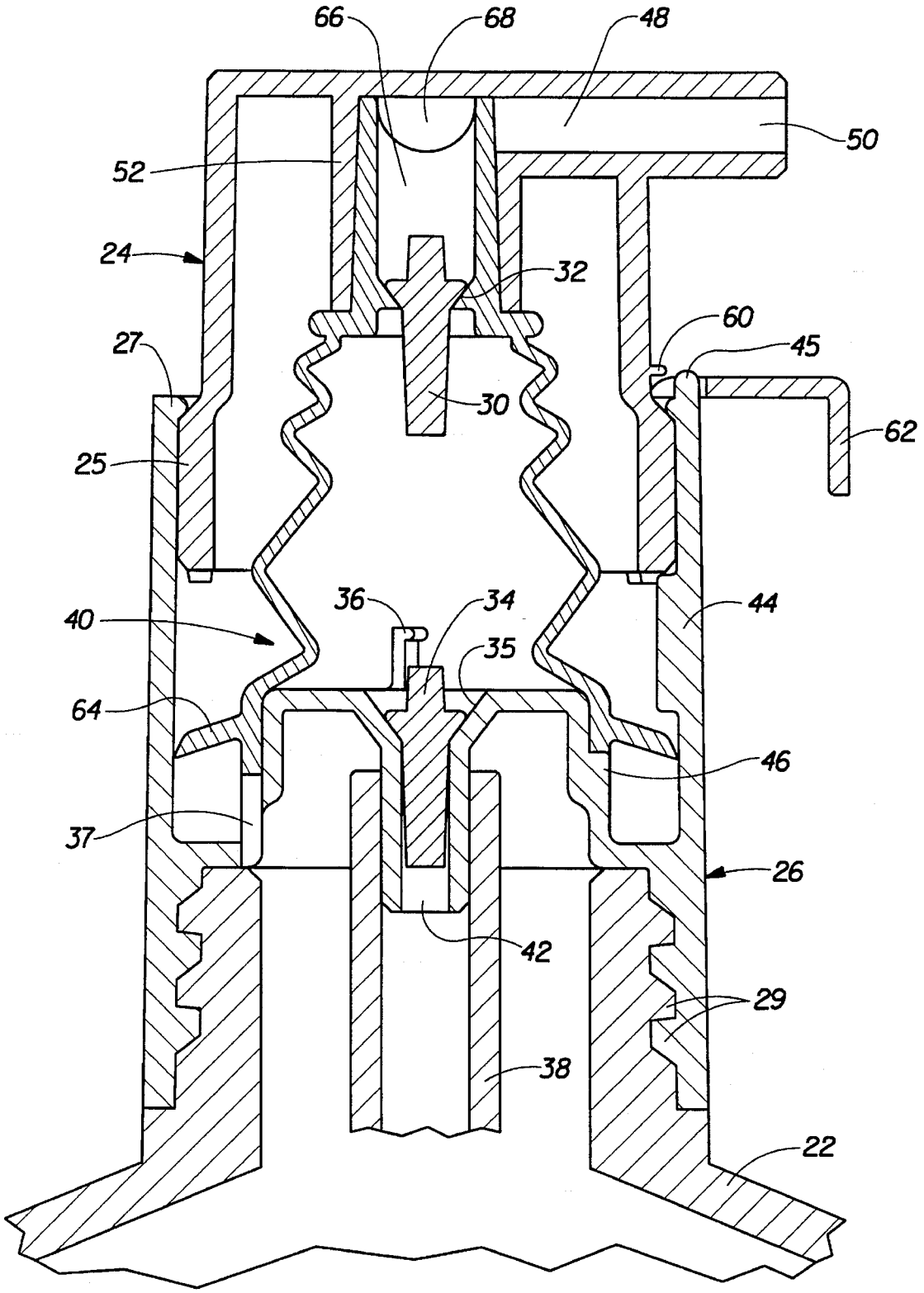
FIG. 3 is a cross-sectional view taken along the center line of the assembled liquid dispensing pump device of FIGS. 1 and 2 (with the tamper evident tab intact and shipping seal closed)

Referring to FIG. 3, the upper housing 24 is telescoped onto the lower housing 26 and retained by cooperation between an annular collar 25 and an annular rib 27. The lower housing 26 includes screw threads 28 which operate to sealingly attach the pump device 20 to the container 22. Alternatively, the lower housing 26 may utilize a bayonet-type attachment structure (not seen) such as that described, for example, in U.S. Pat. No. 4,781,311 issued to Dunning et al. on Nov. 1, 1988; or U.S. Pat. No. 3,910,444 issued to Foster on Oct. 7, 1975.

Additionally, the lower housing 26 includes an inlet passage 42 with an inner conical inlet valve seat 35 which cooperates with the inlet valve member 34 to form the inlet valve 34 and 35. Furthermore, the lower housing 26 includes three equally spaced retaining tabs 36 which retain the inlet valve member 34 during operation of the pump device 20, as discussed hereinafter. Alternatively, a ball valve (not seen) could be utilized. The lower housing 26 also includes a vent opening 37, three equally spaced actuation lugs 44, a cooperating lug 45, and three equally spaced anti-rotation lugs 46. Friction fit onto the inlet passage 42 of the lower housing 26 is a diptube 38 which extends down into the container 22.

Figure 2:
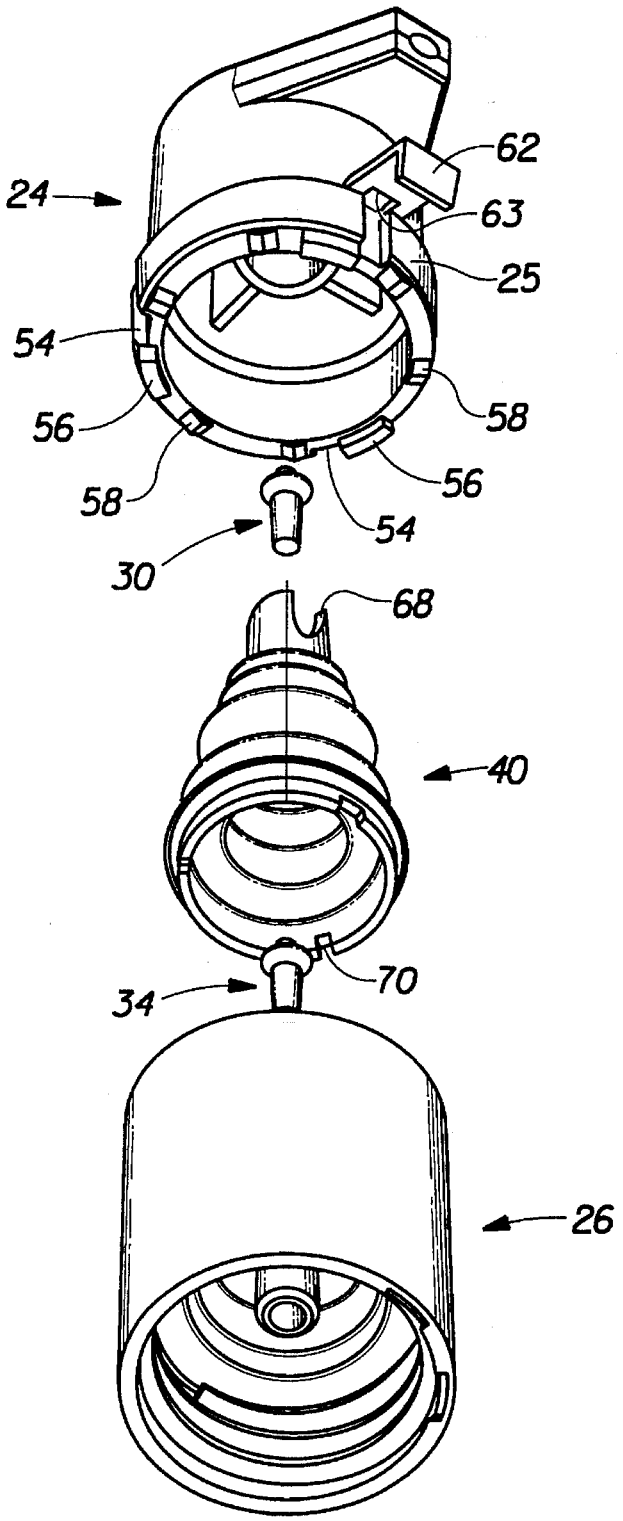
FIG. 2 is an expanded perspective view from below of the manually collapsible pump chamber and liquid dispensing pump of FIG. 1.

The upper housing 24 includes an outlet passage 48; terminating in a dispensing opening 50. An inner cylindrical wall 52 is located within the upper housing 24 at an angle to, and connected with the outlet passage 48. Additionally, (as seen in FIG. 2) the upper housing 24 includes a collar 25 with three equally spaced actuation channels 54, three stops 56, three pairs of tactile lugs 58, a projection 60, and a removable tamper evident tab 62. As used herein, the phrase "tamper evident" is defined as providing evidence that the pump has been previously actuated; not necessarily that the product has not been tampered with (since the entire pump device may be unscrewed and replaced). Tamper evidence, in this sense is important because it discourages sampling of the product on the store shelf. Moreover, the housing 24 and 26 could include any tamper evident feature (not seen) known in the art to indicate that there has been removal of the pump device 20 from the container 22.

Passing through the housing 24 and 26 is a liquid passage which is delineated by several parts, including the diptube 38, the inlet passage 42 of the lower housing 26, the outlet passage 48 of the upper housing 24, and the collapsible pump chamber 40. The liquid passage provides fluid communication from the distal end of the dip tube 38 within the supply container 22 in a downstream direction to the discharge orifice. As used herein, the term "downstream" is defined as in the direction from the supply container 22 to the discharge orifice 50; and "upstream" is defined as in the direction from the discharge orifice 50 to the supply container 22. Similarly, as used herein, the phrase "inlet end" means the upstream end; and the phrase "outlet end" means the downstream end.

A portion of this liquid passage is defined by the collapsible pump chamber 40. The collapsible pump chamber 40 has a structure which is flexible such that it can be manually compressed; thereby reducing the volume within the collapsible pump chamber 40. Although a spring (not seen) may be utilized to help return the collapsible pump chamber 40 to its original shape, the collapsible pump chamber 40 is preferably sufficiently resilient that it returns to its initial shape when the manual compression force is released.

The collapsible pump chamber is a bellows 40 with a structure which ensures the bellows 40 collapses along a predetermined pattern. In general, the bellows 40 preferably has several qualities. For example, the bellows 40 should make the pump device easy to actuate. Generally this means having a spring force from about three pounds to about five pounds. The bellows 40 should also have good resiliency with minimal hysterisis and creep. Furthermore, the bellows 40 preferably has good stiffness in the radial direction (hoop strength) to ensure the bellows 40 is not radially deformed under normal operating conditions. Lastly, the bellows 40 preferably has a good volumetric efficiency; i.e., change in internal volume divided by the total expanded internal volume.

Some geometric features which can be utilized to endow the bellows 40 with the appropriate qualities include the diameter of the bellows 40. The larger the diameter the lower the spring force and the lower the radial stiffness. Although lower spring force is generally desirable, lower radial stiffness can be a problem; e.g., the bellows 40 might blow out in a precompression trigger sprayers. Increasing the wall thickness of the pleats will increase radial stiffiness but it increases the spring force and results in decreased volumetric efficiency of the bellows. Reducing the pleat angle generally decreases the spring force but decreases the volumetric efficiency. The pleat angle is the aggregate of two angles; the angle above a line normal to the axis and passing through the origin of a pleat and the angle below that line. Preferably, the pleat angle above the normal line is about 30° and the pleat angle below the normal line is about 45° (making removal of the bellows from the core pin easier). Increasing the number of pleats will lower the spring force and lower the volumetric efficiency.

Although not wishing to be bound, it is believed that the major components of the spring force are the wall thickness and the upper and lower pleat angles while the major component of resiliency is material selection. Consequently, one way to endow the bellows with portions which will collapse first (such as the smaller diameter portions of the illustrated bellows 40) is to utilize thinner walls and more acute pleat angles in these areas. In fact, as seen in FIG. 3, the side wall of the illustrated bellows 40 gets gradually thinner from bottom to top. Similarly, the pleat angles get progressively more acute. Thus, this bellows 40 will begin by collapsing on its upper end and dispensing a relatively low volume; giving good control for small doses. As actuation of the pump device 20 continues, and assuming a constant speed of actuation, the flow rate will gradually increase.

Material selection can also help endow the bellows 40 with the appropriate qualities. In general the material preferably has a Young's modulus below 10,000 psi. For lotion pumps the a Young's modulus below 3,000 psi is preferred. The material should enable retention of mechanical properties, be dimensionally stable and be resistant to stress cracking. These properties should be present over time in air and in the presence of the liquid product. Thus, for trigger sprayers which generally spray acidic or alkaline cleaning products comprised of significant quantities of water the material should not be pH sensitive and should not undergo hydrolysis. Exemplary such materials include polyolefins such as polypropylene, low density polyethylene, very low density polyethylene, ethylene vinyl acetate. Other materials which may be utilized include thermosets (e.g., rubber), and thermoplastic elastomers. Most preferred for trigger sprayers is a high molecular weight ethylene vinyl acetate with a vinyl acetate content between about 10 and 20 percent. For other pumps (e.g., lotion pumps) pH and hydrolysis may not be an issue. Instead a low spring force with a high resiliency may be more important. In such cases a low modulus ethylene vinyl acetate or a very low density polyethylene are preferred.

The inlet end of the manually compressible pump chamber 40 is attached by friction fit to the generally cylindrical inner wall of the lower housing 26. When attached, three equally spaced notches 70 on the inlet end of the bellows 40 cooperate with the three anti-rotation lugs 46 on the lower housing 26. The collapsible pump chamber 40 includes an integral annularly extending flange 64 near its inlet end. This flange 64 seals against the interior surface of the lower housing 26; to form a vent valve 26 and 64. Thus, the vent valve 26 and 64 includes the flange 64 which operates as a valve member and the housing 26 which provides the valve seat.

Similarly, the outlet end of the collapsible pump chamber 40 is attached by friction fit to the inner cylindrical wall 52 of the upper housing 24. The outlet end of the collapsible pump chamber 40 includes an elongate channel 66 which has an integral outlet valve seat 32 which cooperates with the outlet valve member 30 to form the outlet valve 30 and 32. The elongate channel 66 also includes an integral outlet opening 68.

The inlet valve member 34 and 35 and an outlet valve member 30 and 32 are located within the liquid passage. These valves may be of any type known in the art, including duckbill, ball, poppet or the like. Preferably the outlet valve member 30 is a lightweight ball or poppet valve member which provides suckback, as discussed hereinafter.

As seen in FIG. 3, the liquid dispensing pump 20 is in the closed position. In this position the outlet opening 68 of the bellows 40 is misaligned with the outlet passage 48; providing a fluid tight shipping seal. The shipping seal includes several functional elements; e.g., the outlet opening 68 and the cylindrical wall 52 which can be moved relative thereto to seal the outlet opening 68. Therefore, the liquid passage which flows through the diptube 38, inlet passage 42 of the lower housing 26, the bellows 40, and the outlet passage 48 of the upper housing 24 is sealed closed; thereby providing a shipping seal.

Additionally, the actuation lugs 44 are misaligned with the actuation channels 54 which prevents actuation of the pump device 20 when the shipping seal is closed. Without this feature, a increase in the pressure within the collapsible pump chamber 40 which might damage the collapsible pump chamber 40 could be caused by attempted actuation of the pump device 20 while the shipping seal is closed. In the closed position, one side of the upper end of each actuation lug 44 is located against one end of each stop 56. The other side of each actuation lug 44 is located against one of the tactile lugs 58.

Furthermore, the tamper evident tab 62 extends generally horizontally from the upper housing 24 over the top end of the lower housing 26. The illustrated tamper evident tab 62 includes a slot 63 which cooperates with a locking lug 45 to prevent rotation of the upper housing 24 relative to the lower housing 26. Thus, the shipping seal cannot be opened without removal of the tamper evident tab 62. Furthermore, the pump device 20 cannot be actuated without removing the tamper evident tab 62.

Figure 4:
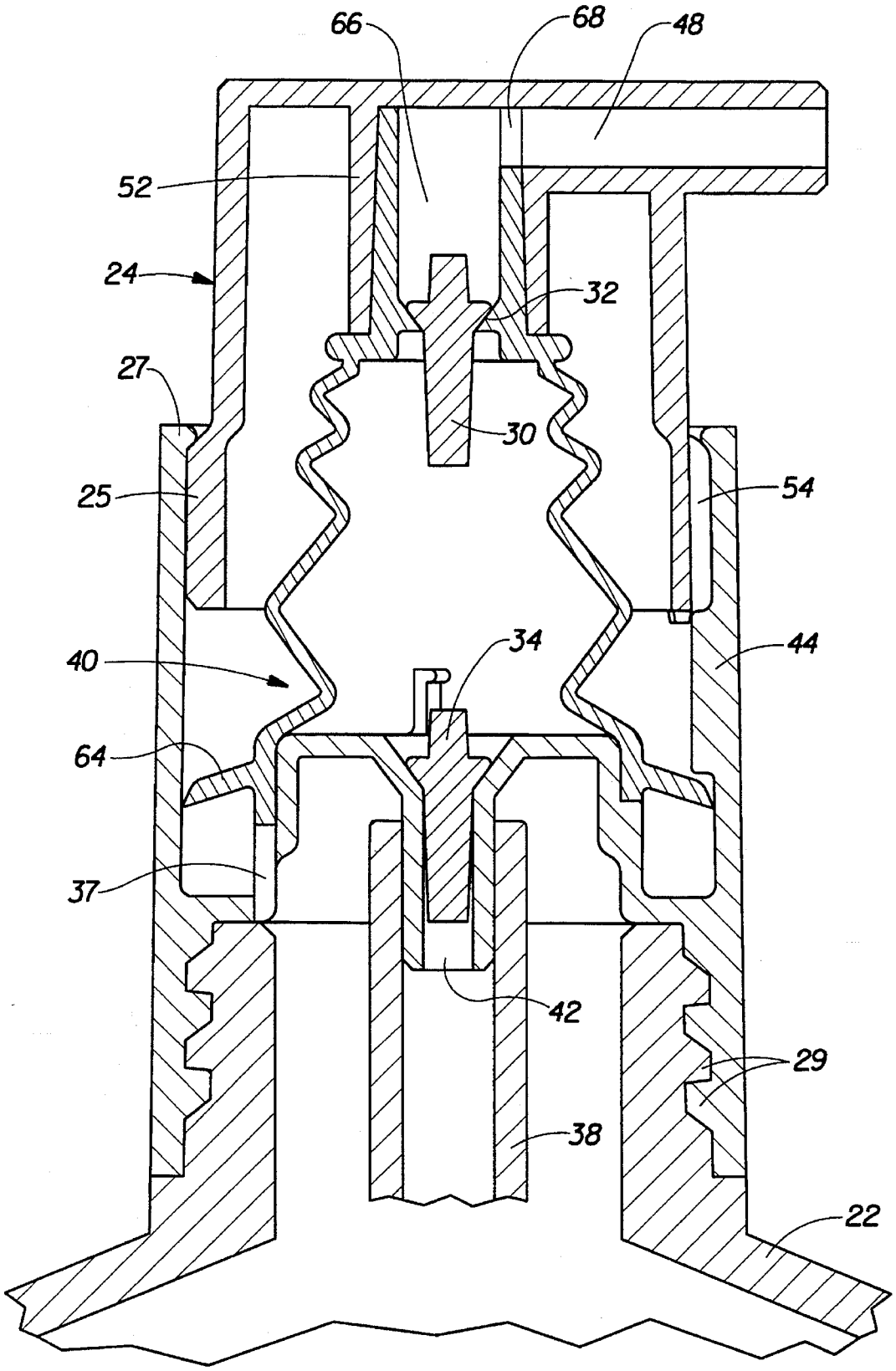
FIG. 4; is a cross sectional view, similar to FIG. 3 with the tamper evident tab removed and the shipping seal open.

As seen in FIG. 4, the liquid dispensing pump 20 is in the open position. The upper housing 24 may be rotated relative to the lower housing 26 from the closed position to the open position once the tamper evident tab 62 has been removed. The tamper evident tab 62 is removed by simply rotating it upwardly. This rotation causes the projection 60 to interfere with the tamper evident tab 62; creating a force which pushes the tab 62 away from the upper housing 24. This force causes the tab 62 to tear away from the upper housing 24 along the thinned line connecting the tab 62 to the upper housing 24. Thus, continued rotation of the tab 62 causes the tamper evident tab 62 to break off of if the tab 62 is rotated to a point where the locking slot 63 and the locking lug 45 release, due to this force. Consequently, the shipping seal cannot be opened until the tamper evident tab 62 is broken off. Needless to say this prevents on shelf sampling of the liquid product through actuation of the pump device 20 without leaving evidence of such sampling.

As the upper housing 24 is rotated, each actuation lug 44 moves from a position against one stop 56 to a position 90° away against the adjacent stop 56. During rotation, each actuation lug 44 moves against the tactile lugs 58 which provide a tactile and/or audible signal that the shipping seal of the dispensing pump device 20 is being moved -first, from the closed position and - second, into the open position. The tactile lugs 58 also help maintain the pump device 20 in the open or closed position through interaction with the actuation lugs 44.

Referring to FIG. 4, in the open position the actuation lugs 44 align with the actuation channels 54. Furthermore, the integral dispensing opening 68 aligns with the outlet passage 48; thereby opening the liquid passage. As the upper housing 24 is rotated relative to the lower housing 26, the upper housing 24 is also rotated relative to the bellows 40. The bellows 40 remains stationary relative to the lower housing 26 due in part to the cooperation between notches 70 on the inlet end of the bellows 40 and the anti-rotation lugs 46 of the lower housing 26. In contrast, the elongate channel 66 of the bellows 40 rotates within the inner cylindrical wall 52 of the upper housing 24 until the outlet opening 68 aligns with the outlet passage 48.

Figure 5:
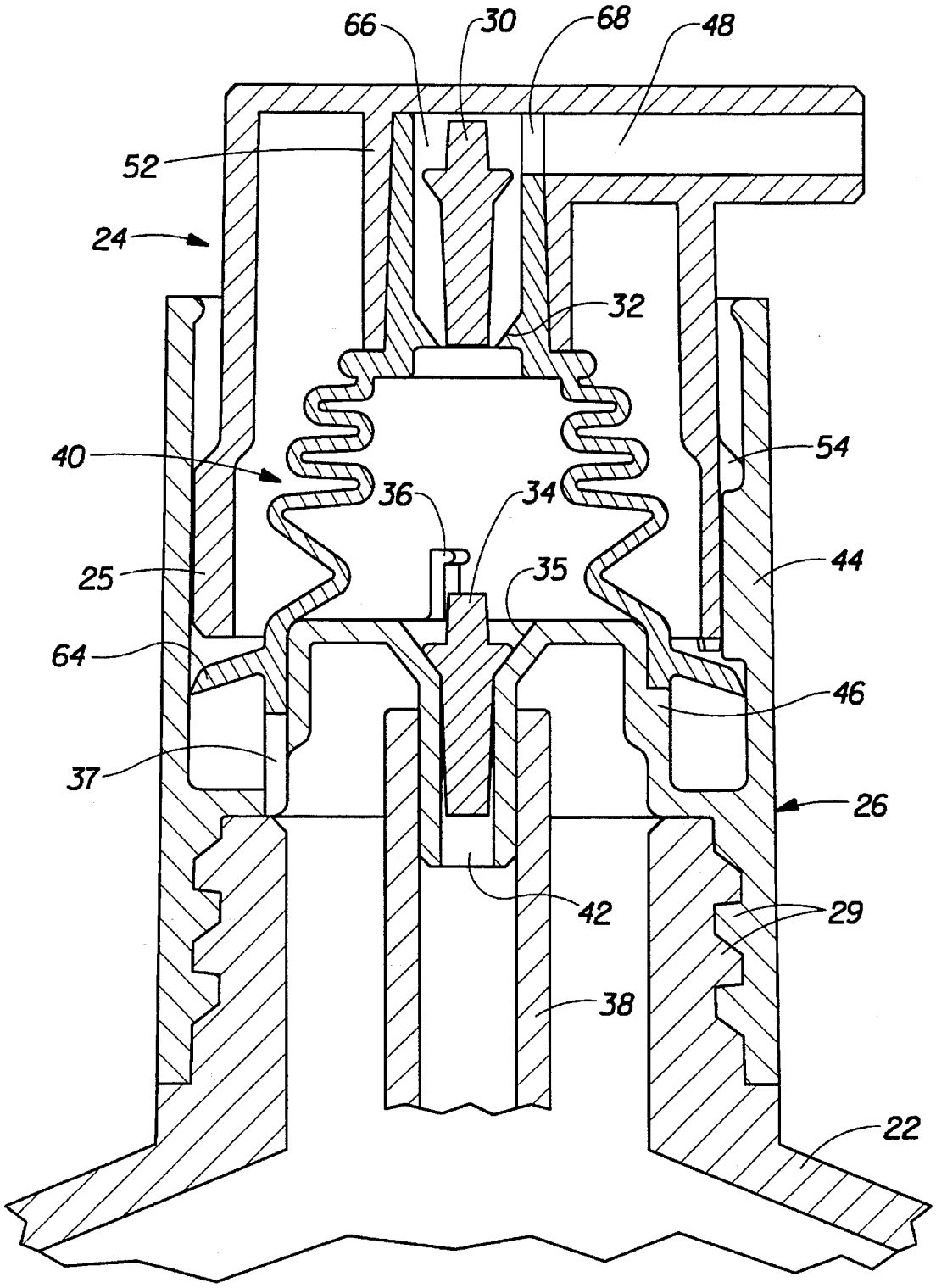
FIG. 5 is a cross sectional view, similar to FIG. 3, of the pump of FIG. 1 in operation, during the downstroke as the collapsible pump chamber collapses.

Referring to FIG. 5, once the pump device is in the open position it is ready for manual actuation. Manual actuation of the pump device 20 is accomplished by axially reciprocating the upper housing 24 relative to the lower housing 26. As this reciprocating action is accomplished the actuation lugs 44 slide within the actuation channels 54. During the downstroke of this reciprocating action, the inlet valve member 34 is sealed against the inlet valve seat 35. This causes pressure to increase within the collapsible pump chamber 40 which causes the outlet valve member 30 to move away from the outlet valve seat 32; thereby opening the outlet valve 30 and 32. Consequently, the liquid within the decreasing volume of the collapsible pump chamber 40 is dispensed through the integral outlet opening 68 and the outlet passage 48. As the liquid is dispensed it provides an upward force on the outlet valve member 30 which can move the outlet valve member 30 to the distal end of the integral elongate channel 66.

As seen in FIG. 5, this bellows 40 will begin by collapsing at the upper end with the thinner wall and the more acute pleat angles. This portion of the bellows 40 (i.e., its upper end) gets progressively larger in diameter toward the bottom thereof. Consequently, the initial collapse will result in a relatively small volume of liquid being dispensed per given stroke length initially and gradually increasing. Thus, if a small dose is required, this bellows provides good control during initial actuation. Should a larger dose be required, the continued actuation of the bellows will result in a higher volume of product being dispensed per given stroke length; thereby increasing the flow rate.

Upon release of the manually compressive force, the bellows 40 begins to expand, due to its resiliency. A spring (not seen) may alternatively be added to replace or supplement the resiliency of the bellows 40. This expansion creates a negative pressure (i.e., below atmospheric) within the collapsible pump chamber 40. Consequently, atmospheric pressure pushes liquid in the outlet passage 48 back into the bellows 40 (at least relatively viscous liquids) until the outlet valve member 30 again seals against the outlet valve seat 32; thereby closing the outlet valve 30 and 32. Of course, the longer the integral elongated channel 66, the more time it takes for the valve member 30 to seat, and the more liquid is sucked back into the bellows 40. Such suck back is desirable since it helps keep the dispensing passage clear between operations.

Figure 6:
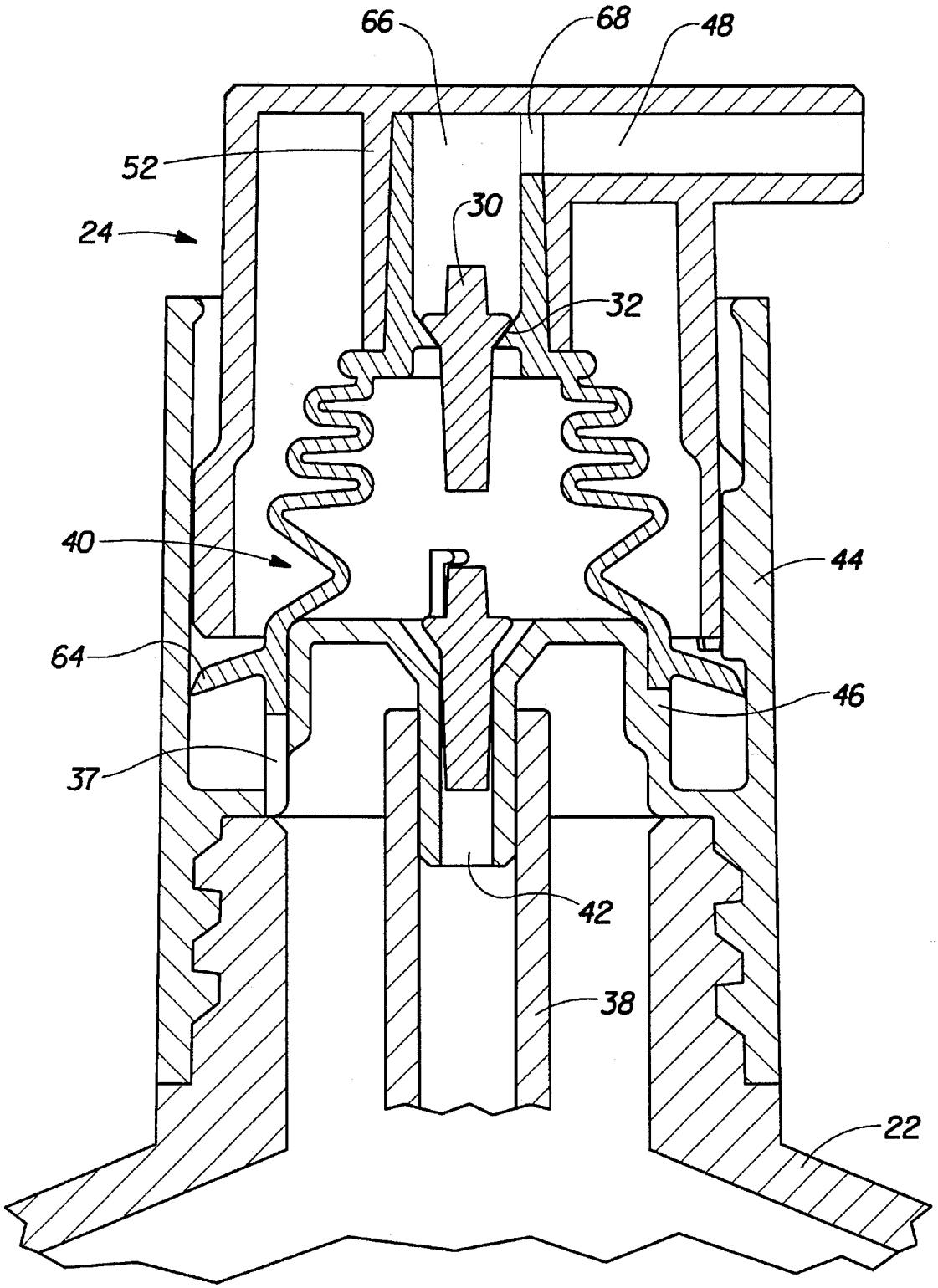
FIG. 6 is a cross sectional view, similar to FIG. 3, of the pump of FIG. 1 in operation, during the upstroke as the collapsible pump chamber expands.

Referring to FIG. 6, once the outlet valve 30 and 32 closes the negative pressure within the bellows 40 created as the bellows 40 continues to expand, causes the inlet valve member 34 to move away from the inlet valve seat 35; thereby opening the inlet valve 34 and 35. The inlet valve member 34 is retained from moving too far from the inlet valve seat 35 by the three retaining lugs 36. Thus, liquid from within the container 22 is pulled into the bellows 40 via the diptube 38 and past the inlet valve 34 and 35. Simultaneously, air is able to enter the container 22 to replace the volume of liquid exiting the container 22 by passing around the cup seal of the annular flange vent valve member 64 and the vent valve seat 26 and into the container 22 through the vent opening 37.

Figure 7:
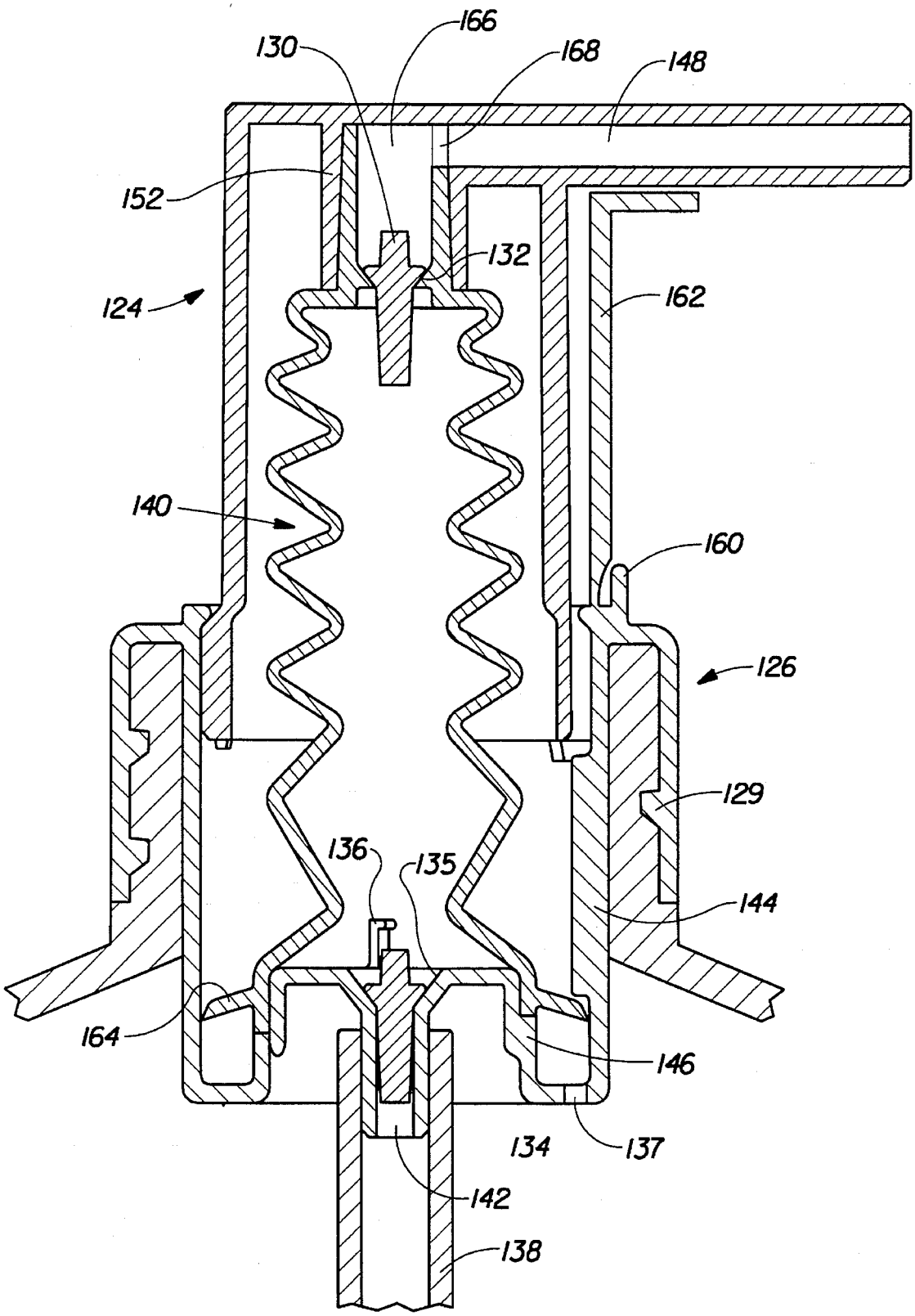
FIG. 7 is a cross-sectional view, similar to FIG. 3, of another preferred collapsible pump chamber of the present invention capable of pumping relatively large volumes in another liquid dispensing pump device.

Referring to FIG. 7, a large dose embodiment of a dispensing pump device of the present invention, indicated generally as 120, is provided. This pump device 120 is substantially identical to the previous pump device 20. The lower housing 126, however, extends into the container 122 to permit a bellows 140 of increased length. The tamper evident tab 162 is attached to the lower housing 126 instead of the upper housing 124. Although the tamper evident tab 162 does not prevent rotating the pump device 120 between open and closed shipping seal positions, it prevents actuation of the pump device 120 through interference with the nozzle surrounding the outlet passage 148 when in the open shipping seal position. Operation of this pump device 120 is substantially identical to that discussed above with respect to the previous pump device 20.

Figure 8:
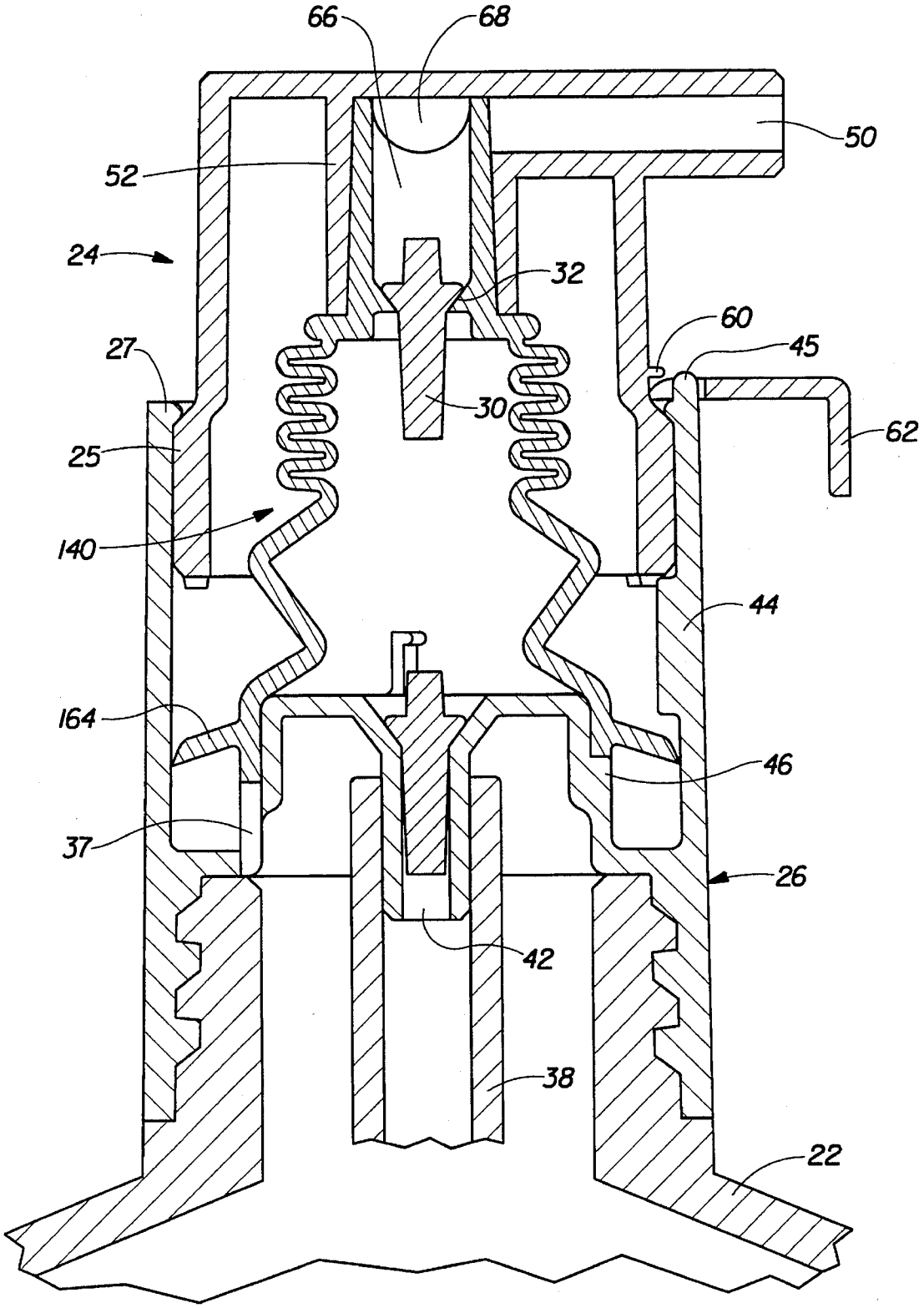
FIG. 8 is a cross-sectional view, similar to FIG. 3, of the collapsible pump chamber of FIG. 7 in the liquid dispensing pump device of FIG. 1.

The diameter of the bellows 140 is constant. However, the bellows 140 includes a thin wall section at its upper end and a relatively thick wall section at its lower end. In addition, the pleat angles at the upper end are more acute than the pleat angles of the thick wall section. Consequently, the upper end of this bellows 140 will collapse first, and then the lower end of this bellows 140 will collapse. Since the diameter is essentially unchanged the volume of liquid dispensed per given stroke length will be essentially constant throughout the collapse. However, as seen in FIG. 8, this bellows is also suitable for use with the pump device of FIG. 1.

Although particular embodiments of the present invention have been illustrated and described, modifications may be made without departing from the teachings of the present invention. For example, the liquid may be discharged in a simple liquid stream (as in with a lotion pump) wherein the nozzle is an open channel; or as a foam wherein air is mixed with the liquid (e.g., through use of a venturi) at or near a foam forming device (e.g., a screen or static mixer). Accordingly, the present invention comprises all embodiments within the scope of the appended claims.

What we claim is:

1. A manually actuated dispensing pump device for pumping a liquid from a supply container and discharging the liquid through a discharge orifice comprising:

(a) a housing for sealingly mounting the dispensing pump device onto the supply container, the housing including a portion of a liquid passage providing fluid communication from the supply container downstream to the discharge orifice;

(b) an inlet valve located within the liquid passage, the inlet valve being closed to prevent liquid flow therethrough during periods of positive downstream pressure and being open during periods of negative downstream pressure;

(c) an outlet valve located within the liquid passage, the outlet valve being open to permit liquid flow therethrough during periods of positive upstream pressure and being closed during periods of negative upstream pressure, and (d) a collapsible pump chamber defining a portion of the liquid passage downstream of the inlet valve and upstream of the outlet valve, the collapsible pump chamber including a pleated annular side wall defining a portion of the pump chamber and having a structure adapted to collapse in a predetermined pattern in response to a manually compressive force as the pump device is actuated, and the pleated annular side wall having a structure which is sufficiently resilient to expand the collapsible pump chamber upon removal of the manually compressive force.

2. A manually actuated dispensing pump device according to claim 1 wherein the pleated annular side wall has a thickness and variations in the thickness of the pleated annular side wall provides some portion of the structure adapted to cause collapse of the side wall in the predetermined pattern as the pump device is actuated.

3. A manually actuated dispensing pump device according to claim 1 wherein the pleated annular side wall has pleat angles and variations in the pleat angles of the pleated annular side wall provide some portion of the structure adapted to cause collapse of the side wall in the predetermined pattern as the pump device is actuated.

4. A manually actuated dispensing pump device according to claim 2 wherein the pleated annular side wall has pleat angles and variations in the pleat angles of the pleated annular side wall provide some portion of the structure adapted to cause collapse of the side wall in the predetermined pattern as the pump device is actuated.

5. A manually actuated dispensing pump device for pumping a liquid from a supply container and discharging the liquid through a discharging orifice comprising:

(a) a housing for sealing mounting the dispensing pump device onto the supply container, the housing including a portion of a liquid passage providing fluid communication from the supply container downstream to the discharge orifice;

(b) an inlet valve located within the liquid passage, the inlet valve being closed to prevent liquid flow therethrough during periods of positive downstream pressure and being open during periods of negative downstream pressure;

(c) an outlet valve located within the liquid passage, the outlet valve being open to permit liquid flow therethrough during periods of positive upstream pressure and being closed during periods of negative upstream pressure; and (d) a collapsible pump chamber defining a portion of the liquid passage downstream of the inlet valve and upstream of the outlet valve, the collapsible pump chamber including a pleated annular side wall defining an internal volumetric portion of the pump chamber and having a structure adapted to collapse in a predetermined pattern in response to a manually compressive force as the pump device is actuated, the predetermined pattern of collapse resulting in an initially relatively small volumetric change in the internal volumetric portion per given stroke length followed by an increased volumetric change in the internal volumetric portion per given stroke length, and the pleated annular side wall having a structure which is sufficiently resilient to expand the collapsible pump chamber upon removal of the manually compressive force.

6. A manually actuated dispensing pump device according to claim 5 wherein the pleated annular side wall has a thickness and variations in the thickness of the pleated annular side wall provides some portion of the structure adapted to cause collapse of the side wall in the predetermined pattern as the pump device is actuated.

7. A manually actuated dispensing pump device according to claim 5 wherein the pleated annular side wall has pleat angles and variations in the pleat angles of the pleated annular side wall provide some portion of the structure adapted to cause collapse of the side wall in the predetermined pattern as the pump device is actuated.

8. A manually actuated dispensing pump device according to claim 6 wherein the pleated annular side wall has pleat angles and variations in the pleat angles of the pleated annular side wall provide some portion of the structure adapted to cause collapse of the side wall in the predetermined pattern as the pump device is actuated.

9. A manually actuated dispensing pump device for pumping a liquid from a supply container and discharging the liquid through a discharge orifice comprising:

(a) a housing for sealingly mounting the dispensing pump device onto the supply container, the housing including a portion of a liquid passage providing fluid communication from the supply container downstream to the discharge orifice;

(b) an inlet valve located within the liquid passage, the inlet valve being closed to prevent liquid flow therethrough during periods of positive downstream pressure and being open during periods of negative downstream pressure;

(c) an outlet valve located within the liquid passage, the outlet valve being open to permit liquid flow therethrough during periods of positive upstream pressure and being closed during periods of negative upstream pressure; and (d) a collapsible pump chamber defining a portion of the liquid passage downstream of the inlet valve and upstream of the outlet valve, the collapsible pump chamber having a collapsing side wall defining a portion of the pump chamber, the collapsing side wall having a structure adapted to collapse in a predetermined pattern in response to a manually compressive force as the pump device is actuated, and the collapsing side wall having a structure which is sufficiently resilient to expand the collapsible pump chamber upon removal of the manually compressive force.

10. A manually actuated dispensing pump device according to claim 9 wherein the collapsing side wall has a thickness and variations in the thickness of the side wall provides some portion of the structure adapted to cause collapse of the side wall in the predetermined pattern as the pump device is actuated.

11. A manually actuated dispensing pump device according to claim 9 wherein the collapsing side wall is a pleated annular side wall defining a portion of the pump chamber and having a structure adapted to collapse in a predetermined pattern as the pump device is actuated.

12. A manually actuated dispensing pump device according to claim 11 wherein the pleated annular side wall has a thickness and variations in the thickness of the pleated annular side wall provides some portion of the structure adapted to cause collapse of the side wall in the predetermined pattern as the pump device is actuated.

13. A manually actuated dispensing pump device according to claim 11 wherein the pleated annular side wall has a pleat angle and variations in the pleat angle of the pleated annular side wall provide some portion of the structure adapted to cause collapse of the side wall in the predetermined pattern as the pump device is actuated.

14. A manually actuated dispensing pump device according to claim 12 wherein the pleated annular side wall has pleat angles and variations in the pleat angles of the pleated annular side wall provide some portion of the structure adapted to cause collapse of the side wall in the predetermined pattern as the pump device is actuated.

15. A manually actuated dispensing pump device according to claim 9 wherein the collapsing side wall is a pleated annular side wall defining an internal volumetric portion of the pump chamber and having a structure adapted to collapse in a predetermined pattern as the pump device is actuated, the predetermined pattern of collapse resulting in an initially relatively small volumetric change in the internal volumetric portion per given stroke length followed by an increased volumetric change in the internal volumetric portion per given stroke length.

16. A manually actuated dispensing pump device according to claim 15 wherein the pleated annular side wall has a thickness and variations in the thickness of the pleated annular side wall provides some portion of the structure adapted to cause collapse of the side wall in the predetermined pattern as the pump device is actuated.

17. A manually actuated dispensing pump device according to claim 15 wherein the pleated annular side wall has a pleat angle and variations in the pleat angle of the pleated annular side wall provide some portion of the structure adapted to cause collapse of the side wall in the predetermined pattern as the pump device is actuated.

18. A manually actuated dispensing pump device according to claim 16 wherein the pleated annular side wall has pleat angles and variations in the pleat angles of the pleated annular side wall provide some portion of the structure adapted to cause collapse of the side wall in the predetermined pattern as the pump device is actuated.

19. A manually actuated dispensing pump device according to claim 18, further comprising a shipping seal including to functional elements which cooperate when in a closed position to seal the liquid passage and cooperate when in an open position to permit liquid flow through the liquid passage; and wherein one of the functional elements of the shipping seal is an integral component of the collapsible pump chamber.

20. A manually actuated dispensing pump device according to claim 19 wherein the shipping seal is provided by rotating the functional element which is an integral component of the collapsible pump chamber relative to a first portion of the housing while maintaining the collapsible pump chamber stationary relative to a second portion of the housing through the cooperation of an integral anti-rotation element on the collapsible pump chamber with a cooperating anti-rotation element on the second portion of the housing.

* * * * *